US006629597B2

(12) United States Patent
Barker

(10) Patent No.: US 6,629,597 B2
(45) Date of Patent: Oct. 7, 2003

(54) METHOD AND SYSTEM FOR PACKAGING EXPLOSIVE PRODUCTS FOR TRANSPORTATION

(75) Inventor: James Marshall Barker, Mansfield, TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 10/143,697

(22) Filed: May 8, 2002

(65) Prior Publication Data

US 2002/0134054 A1 Sep. 26, 2002

Related U.S. Application Data

(63) Continuation of application No. 09/764,699, filed on Jan. 18, 2001, now Pat. No. 6,454,085.

(51) Int. Cl.[7] ..... F42B 39/00
(52) U.S. Cl. ..... 206/3; 206/593; 53/446
(58) Field of Search ..... 206/3, 593, 594, 206/522; 253/446; 53/473

(56) References Cited

U.S. PATENT DOCUMENTS

| | | | | | |
|---|---|---|---|---|---|
| 2,352,803 | A | | 7/1944 | Sawin | |
| 2,667,968 | A | | 2/1954 | Ritchie | |
| 2,954,140 | A | | 9/1960 | Sutherland et al. | |
| 3,572,499 | A | | 3/1971 | Mondano | |
| 3,999,653 | A | | 12/1976 | Haigh et al. | |
| 4,286,708 | A | | 9/1981 | Porzel | |
| 4,306,653 | A | | 12/1981 | Fales | |
| 4,522,871 | A | * | 6/1985 | Armellino et al. | 442/135 |
| 4,664,967 | A | * | 5/1987 | Tasdemiroglu | 428/220 |
| 4,682,708 | A | | 7/1987 | Pool | |
| 4,877,131 | A | * | 10/1989 | Patros et al. | 206/317 |
| 5,044,252 | A | * | 9/1991 | Gamadi et al. | 86/50 |
| 5,097,945 | A | | 3/1992 | Brooks | |
| 5,267,652 | A | | 12/1993 | Carroll | |
| 5,450,948 | A | | 9/1995 | Beausoleil et al. | |
| 5,753,850 | A | | 5/1998 | Chawla et al. | |
| 6,253,915 | B1 | * | 7/2001 | Mesica et al. | 206/317 |
| 6,454,085 | B1 | * | 9/2002 | Barker | 206/3 |

* cited by examiner

*Primary Examiner*—Shian Luong
(74) *Attorney, Agent, or Firm*—Lawrence R. Youst; Danamraj & Youst, P.C.

(57) ABSTRACT

A system and method for packaging shaped charges (12) for transportation is disclosed. Each shaped charge (12) includes a housing (14) and a liner (16) having a high explosive disposed therebetween. A jet spoiler (20) is positioned proximate the liner (16) of each of the shaped charges (12) to prevent the formation of a jet in the event of an inadvertent initiation of a shaped charge (12). The shaped charges (12) are then oriented in first and second layers such that the jet spoilers (20) positioned proximate the liners (16) of the shaped charges (12) in the first and second layers oppose one another. A shielding panel (22) is disposed between the shaped charges (12) of the first and second layers. The shaped charges (12) including the jet spoilers (20) and the shielding panel (22) are placed within an expandable bag (32) which is in turn enclosed within a transportation container (34).

24 Claims, 5 Drawing Sheets

METHOD AND SYSTEM FOR PACKAGING EXPLOSIVE PRODUCTS FOR TRANSPORTATION

CROSS REFERENCE TO RELATED APPLICATION

This is a continuation of application Ser. No. 09/764,699, entitled Method and System for Packaging Explosive Products for Transportation, filed on Jan. 18, 2001, now U.S. Pat. No. 6,454,085.

TECHNICAL FIELD OF THE INVENTION

The present invention relates in general to transportation of explosive products and, in particular to, a method and system of packaging explosive products such that the transportation thereof may take place under a favorable shipping classification.

BACKGROUND OF THE INVENTION

Without limiting the scope of the invention, its background is described in connection with shaped charges for perforating hydrocarbon wells to allow for hydrocarbon production, as an example. Shaped charges are typically used to make hydraulic communication passages, called perforations, in a wellbore drilled into the earth that intersects hydrocarbon formations. The perforations are needed as casing is typically cemented in place within the wellbore thereby hydraulically isolating the various formations penetrated by the wellbore. Once the perforations are formed, hydrocarbon fluids may enter the wellbore from the intersected formation.

The shaped charges typically include a housing, a quantity of high explosive and a liner. The liners typically have a generally conical shape, however, the liners could have other shapes including, but not limited to, a generally parabolic shape. The liners are generally formed by compressing powdered metal, however, other techniques may be used to form the liners such as stamping them from sheet metal. In operation, the perforations are made by detonating the high explosive which causes the liner to form a jet that is ejected from the shaped charge at very high velocity. The jet is able to penetrate the casing, the cement and the formation, thereby forming the perforations.

As hydrocarbon producing wells are drill throughout the world, the shaped charges used to perforate the wellbores must be shipped on a worldwide basis. As stated, the shaped charges used to perforate wellbores are explosive products. Thus, the transportation of such shaped charges is highly regulated. For example, shaped charges must be packaged in approved boxes and shipped according to guidelines promulgated by a competent authority. Depending upon the type of shaped charge and how it is packaged, there are several possible shipping classifications for the transportation of shaped charges.

One of the most favorable shipping classifications for transportation of shaped charges is Compatibility Group S of Division 1.4 as promulgated in the United Nations Recommendations on the Transport of Dangerous Goods, which will be referred to herein as U.N. 1.4S. If a product is assigned a U.N. 1.4S classification, this implies that there is no hazard of a mass detonation among a group of boxes containing explosive articles and that if a single explosive article inadvertently initiated inside a box, then no hazardous effects would emanate from the box. For example, when a product is assigned a U.N. 1.4S classification, this implies that if a first-responder to the accident, such as a firefighter, were within a few feet of a box of explosive articles, then there would be no danger of explosion hazards to the responder while the fire is being fought. In addition, if a product is assigned a U.N. 1.4S classification, this means that the packaged product is judged sufficiently safe for transportation on passenger-carrying aircraft and that packages that have different types of explosive products, for example, shaped charges and detonators, may be shipped together in the same transportation vehicle.

To evaluate whether a package of explosive articles can obtain a U.N. 1.4S classification, it must pass a series of tests described in the United Nations Recommendations on the Transport of Dangerous Goods. Specifically, Test Series 6, which including Tests 6(a), 6(b) and 6(c), is used to determine in which division, amongst Divisions 1.1, 1.2, 1.3 and 1.4 a particular explosive article should be placed. Of particular interest in the transportation of shaped charges is Test 6(a). Test 6(a) is used to determine whether there is a mass explosion of the contents of a single package when one component inside the package is initiated. During the test, the package is confined using boxes or bags that are completely filled with earth or sand and placed as close as possible around the test package to a minimum thickness of confinement in every direction of 0.5 meters or 1.0 meter depending upon the size of the test package.

At least one testing agency outside of the United States, however, has questioned a validity of Test 6(a) due to the confinement of the test package. Instead, this agency has proposed a modification of Test 6(a) which would no longer include the confinement of the test package. While the present packaging methodology used for shaped charges has enabled transportation under the U.N. 1.4S classification, early test results indicate that the present packaging methodology may not be sufficiently robust to pass an unconfined Test 6(a). Therefore, a need has arisen for an improved system and method for packaging shaped charges that will allow such shaped charges, as well as other explosive components, to pass an unconfined Test 6(a) such that the U.N. 1.4S classification will remain achievable.

SUMMARY OF THE INVENTION

The present invention disclosed herein comprises a system and a method of packaging explosive products for transportation that will allow such explosive products to pass an unconfined Test 6(a) such that the U.N. 1.4S classification will remain achievable. In the system and method of the present invention, protection against the discharge of fragments created by an inadvertent initiation of an explosive product is provided by placing the explosive products within an expandable bag. In the event of such an initiation, a large volume of gas is rapidly generated which must be initially contained. The expandable bag proves such containment of the expanding gases along with the containment of any fragments. The expandable bag is preferable made from a ballistic cloth or other material capable of initial containment of expanding gases and containment of any fragments.

The expandable bag may be used either alone or in conjunction with shielding panels. Specifically, the present invention may also utilize shielding panels disposed between the explosive products. These shielding panels may be made from wood, aluminum, ballistic cloth or other material that will absorb fragments in the event of an initiation. Additional shielding panels may be placed around the perimeter of the explosive products.

In addition to positioning the explosive products within the expandable bag or within the shielding panel or both, the explosive products are placed within a transportation container to facilitate transportation. This container may typically be a corrugated cardboard box or a wood box.

In one embodiment of the present invention, when the explosive products are shaped charges, additional protection may be provided by disposing a jet spoiler proximate the liner of each of the shaped charges. Preferably, the jet spoilers used in the present invention approximate the size and shape of the cavity within the shaped charge such that the jet spoilers may be disposed within the housing of the shaped charges and in substantial contact with the liner.

Once the jet spoilers are in place, the shaped charges are oriented in a layer configuration such that the jet spoilers positioned within shaped charges in adjacent layers oppose one another. Each layer may include a single shaped charge, a row of shaped charges or an array of shaped charges. In order to assure that all shaped charges to be transported are oriented such that the associated jet spoilers oppose one another, an even number of layers is used. For example, two layers of shaped charges or four layers of shaped charges are common but other even numbers of layers are also suitable.

As such, in the case of the shaped charges, protection may be provided by jet spoilers, the opposing orientation of the shaped charges, interlayer shielding panels, perimeter shielding panels, intralayer shielding panels and the expandable bag, all of which may be placed within a transportation container to facilitate transportation.

BRIEF DESCRIPTION OF THE DRAWINGS

For a more complete understanding of the present invention, including its features and advantages, reference is now made to the detailed description of the invention, taken in conjunction with the accompanying drawings of which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the invention.

Figures 1, 2:
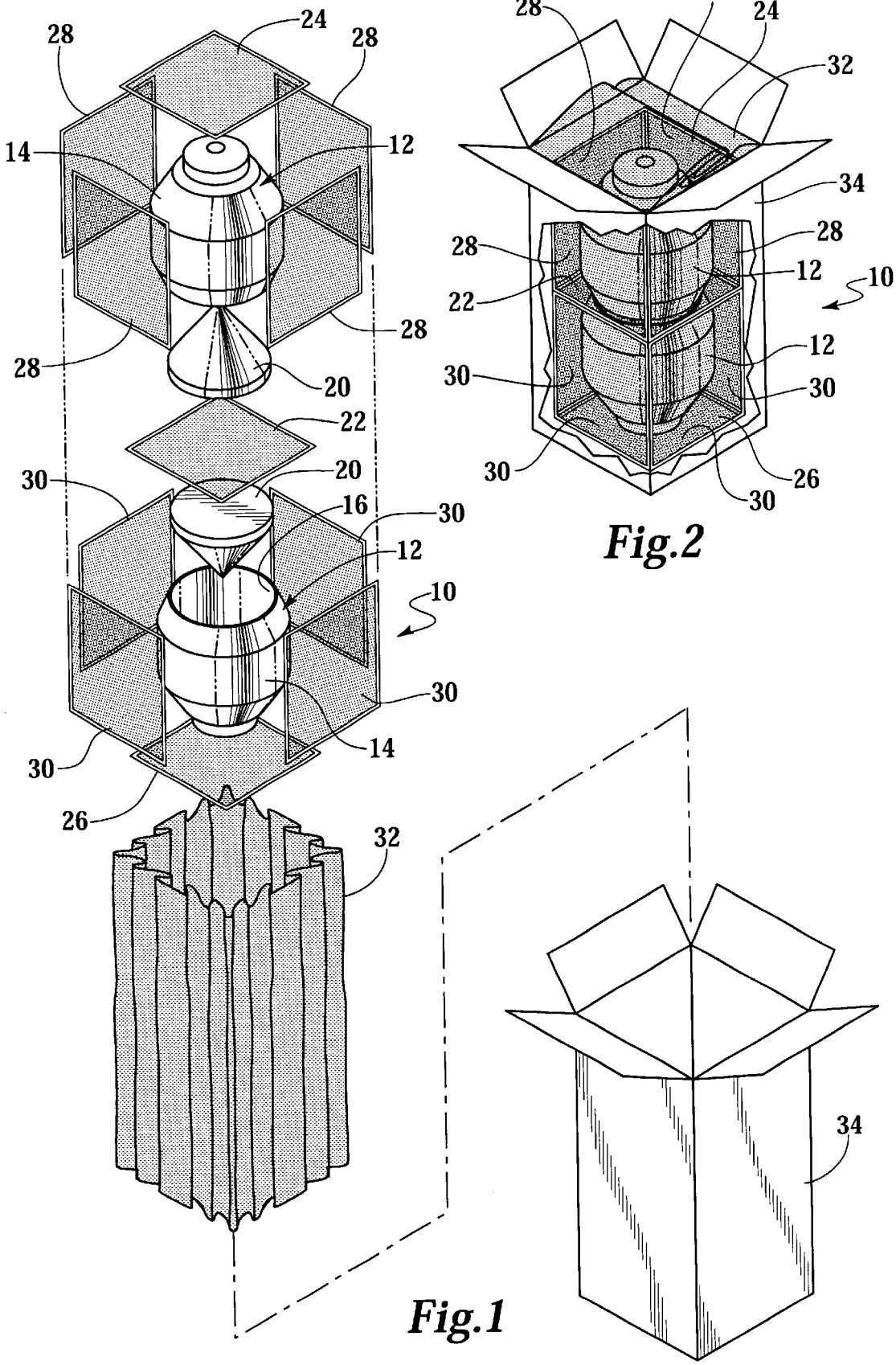
FIG. 1 is an exploded view of a system for packaging explosive products for transportation according to the present invention.
FIG. 2 is a partially cutaway, isometric view a system for packaging explosive products for transportation according to the present invention.

Referring to FIG. 1, a system for packaging explosive products for transportation according to the present invention is depicted and generally designated 10. In the illustrated embodiment, the explosive products are shaped charges 12. Each shaped charge 12 has a generally cylindrically shaped housing 14 that is formed from steel or other suitable material. A quantity of high explosive powder (not pictured) is disposed within housing 14. The high explosive powder may typically be of the type sold under trade designations HMX, HNS, RDX, PYX and PETN. In operation, the high explosive powder is detonated using a detonating signal provided by a detonating cord. A booster explosive may also be used between detonating cord and high explosive powder to efficiently transfer the detonating signal from detonating cord to the high explosive powder.

Each shaped charge 12 has a liner 16 disposed within housing 12 such that the high explosive substantially fills the volume between housing 12 and liner 16. Liner 16 may typically be formed by pressing, under very high pressure, a powdered metal mixture. Following the pressing process, liner 16 becomes a generally conically shaped rigid body that behaves substantially as a solid mass. Alternatively, liner 16 may be stamped from sheet metal or may have a generally parabolic or hemispherical shape.

Upon detonation, intentionally or unintentionally, the force of the detonation collapses liner 16 causing liner 16 to be ejected from housing 12 in the form of a jet traveling at very high velocity toward, for example, a well casing. In this scenario, the jet penetrates the well casing, the cement and the formation, thereby forming the perforations.

During transportation of shaped charges 12 from one location to another, however, it is desirable that no jet be formed even in the event of an inadvertent initiation. One of the safeguards provided by the present invention is to prevent this jet from occurring if a shaped charge 12 is initiated. Prevention of the jet is accomplished using jet spoilers 20. Each jet spoiler 20 is placed within the cavity formed within shaped charge 12 and defined by liner 16. The shape of jet spoilers 20 is preferably substantially the shape of the cavity such that each jet spoiler 20 may be disposed with a housing 14 and in substantial contact with a liner 16. Jet spoilers 20 may be made from a metal or nonmetal, but nonmetals are preferable in order to eliminate potential fragment pieces. For example, jet spoilers 20 may be constructed of a suitably dense material such as wood, plastic, foam, rubber, plaster, cement and the like. Ideally the material would be one that is environmentally friendly for easy disposal, lightweight to facilitate shipping and handling and economical. For example, biodegradable cardboard, balsa wood or compressed sawdust are suitable materials.

When multiple shaped charges 12 are packaged together in accordance with the present invention, shaped charges 12 are oriented such that jet spoilers 20 of adjacent shaped charges 12 oppose one another. This orientation not only inhibits the formation of a jet in the initiated shaped charge 12 but also inhibits the initiation of the opposing shaped charge 12. In the past, shaped charges were placed in an opposing orientation based upon the principle that if one shaped charge initiates and begins to jet, as that jet penetrates the opposing shaped charge, the second shaped charge would initiate such that the resulting detonations from each shaped charge would disrupt the other shaped charge, thereby preventing any jet penetration. In the present invention, however, initiation of a shaped charge 12 with a jet spoiler 20 in place does not create a jet but instead one jet spoiler 20 is propelled against the opposing jet spoiler 20. As jetting does not occur, this corresponding impact load between two opposing shaped charges 12 with jet spoilers 20 is substantially lower than in the case without jet spoilers 20.

Still referring to FIG. 1, a plurality of shielding panels is positioned between and around shaped charges 12. These shielding panels may be made of materials or layers of materials that are resistant to fragments such as wood, aluminum, corrugated cardboard, woven ballistic cloth and the like. In the illustrated embodiment, an interlayer shielding panel 22 is disposed between opposing jet spoilers 20 of shaped charges 12. Likewise, a top shielding panel 24 is disposed above the upper shaped charge 12 while a bottom shielding panel 26 is disposed below the lower shaped charge 12. A set of side shielding panels 28 is positioned around upper shaped charge 12. In a like manner, set of side shielding panels 30 is positioned around lower shaped charge 12. Each of the shielding panels 22, 24, 26, 28 and 30 prevents fragments of shaped charges 12 or jet spoilers 20 from being discharged in the event of an inadvertent initiation.

Even though FIG. 1 has depicted each shielding panel as providing fragment protection in one direction, it should be understood by those skilled in the art that multidirectional arrangements of shielding panels are also contemplated and considered within the scope of the present invention. For example, a bidirectional shielding panel including two side shielding panels 28 that are attached together at right angles to one another or a tridirectional shielding panel including two side shielding panels 28 and top shielding panel 24 attached together at right angles is possible and provides appropriate fragment protection.

In addition, it should be noted by those skilled in the art that directional terms, such as above, below, upper, lower, etc., are used for convenience in referring to the accompanying drawings as it is to be understood that the various embodiments of the present invention described herein may be utilized in various orientations, such as inclined, inverted, horizontal, vertical, etc., without departing from the principles of the present invention.

In the illustrated embodiment, the combination of shaped charges 12, jet spoilers 20 and shielding panels 22, 24, 26, 28 and 30 is disposed within an expandable bag 32. Expandable bag 32 is made from a suitable fragment resistant fabric such a woven ballistic cloth. Expandable bag 32 may be rather loosely fitting when shaped charges 12 are placed therein, but is subsequently folded in a manner that allows it to be placed in transportation container 34, such as a corrugated cardboard box, as best seen in FIG. 2. The loose fitting nature of expandable bag 32 allows for gas expansion, in the event of an inadvertent initiation of a shaped charge 12. Expandable bag 32 is not permanently leak tight. In fact, the primary purpose of expandable bag 32 is to allow for expansion of the explosion gases while retaining all of the contents of its interior such as shaped charges 12, jet spoilers 20, shielding panels 22, 24, 26, 28 and 30, as well as any fragments of material that are created during an explosion. Specifically, expandable bag 32 will expand in a manner similar to an automobile air bag, but will subsequently deflate since expandable bag 32 is not leak tight. In the event of an initiation of one of the shaped charges 12, transportation container 34 will likely be destroyed, but the effects of the explosion will remain localized within expandable bag 32 such that no hazard will exist to a first responder, such as a firefighter, or to passengers or crew on an aircraft.

Even though the explosive products of FIG. 1 have been described as being shaped charges, it should be understood that the present invention is also well-suited for transportation of other explosive products such as detonators, bidirectional boosters, igniters, cutters, explosive pellets and the like, albeit without the need for jet spoilers 20. In addition, as the present invention will allow such explosive products to retain the U.N. 1.4S classification even under an unconfined Test 6(a), a single transportation vehicle will be able to transport more than one type of explosive product at the same time. For example, shaped charges and their detonators may be transported from one location to another on the same transportation vehicle.

Figure 3:
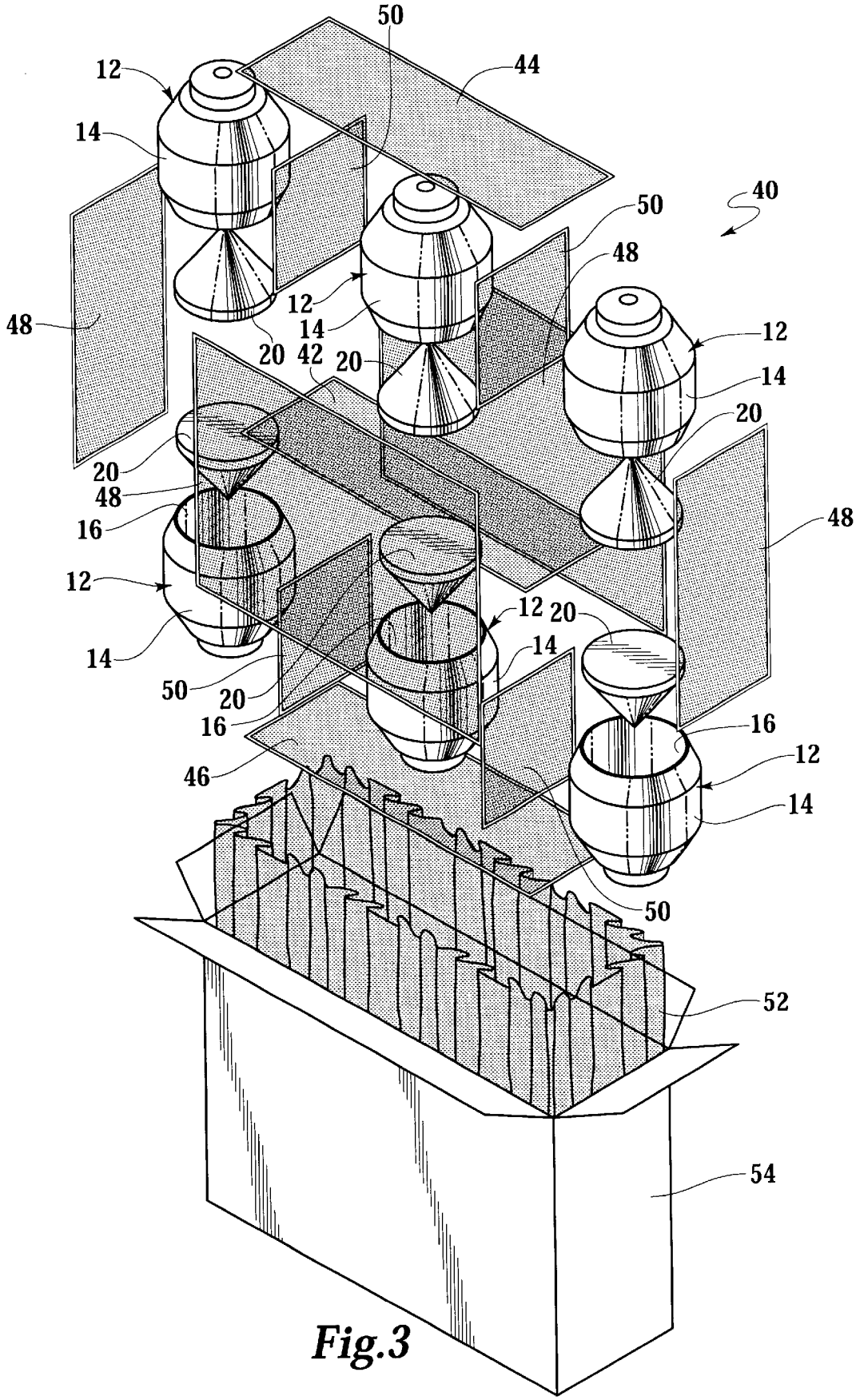
FIG. 3 is an exploded view of a system for packaging explosive products for transportation according to the present invention.

Referring now to FIG. 3, a system for packaging explosive products for transportation according to the present invention is depicted and generally designated 40. In the illustrated embodiment, the explosive products are again depicted as shaped charges 12. Each shaped charge 12 has a generally cylindrically shaped housing 14, a liner 16 and a quantity of high explosive powder that is disposed between housing 14 and liner 16. To prevent a jet from occurring if one of the shaped charges 12 is initiated, a jet spoilers 20 is positioned within the cavity formed within shaped charges 12 and defined by liners 16.

In the illustrated embodiment, shaped charges 12 are oriented in a layer arrangement with three shaped charges 12 in each layer. Shaped charges 12 are oriented within the layers such that jet spoilers 20 in adjacent layers oppose one another. This orientation not only inhibits the formation of a jet in the event of an initiation, but also inhibits the initiation of the opposing shaped charge 12 as one jet spoiler 20 would be propelled against the opposing jet spoiler 20.

A plurality of shielding panels is positioned between and around shaped charges 12. An interlayer shielding panel 42 is disposed between opposing jet spoilers 20 of shaped charges 12 in the two layers. Likewise a top shielding panel 44 is disposed above the upper shaped charges 12 while a bottom shielding panel 46 is disposed below the lower shaped charges 12. A set of perimeter shielding panels 48 is positioned around shaped charge 12. Additionally, a set of intralayer shielding panels 50 is disposed between adjacent shaped charges 12 within each layer.

Figure 4:
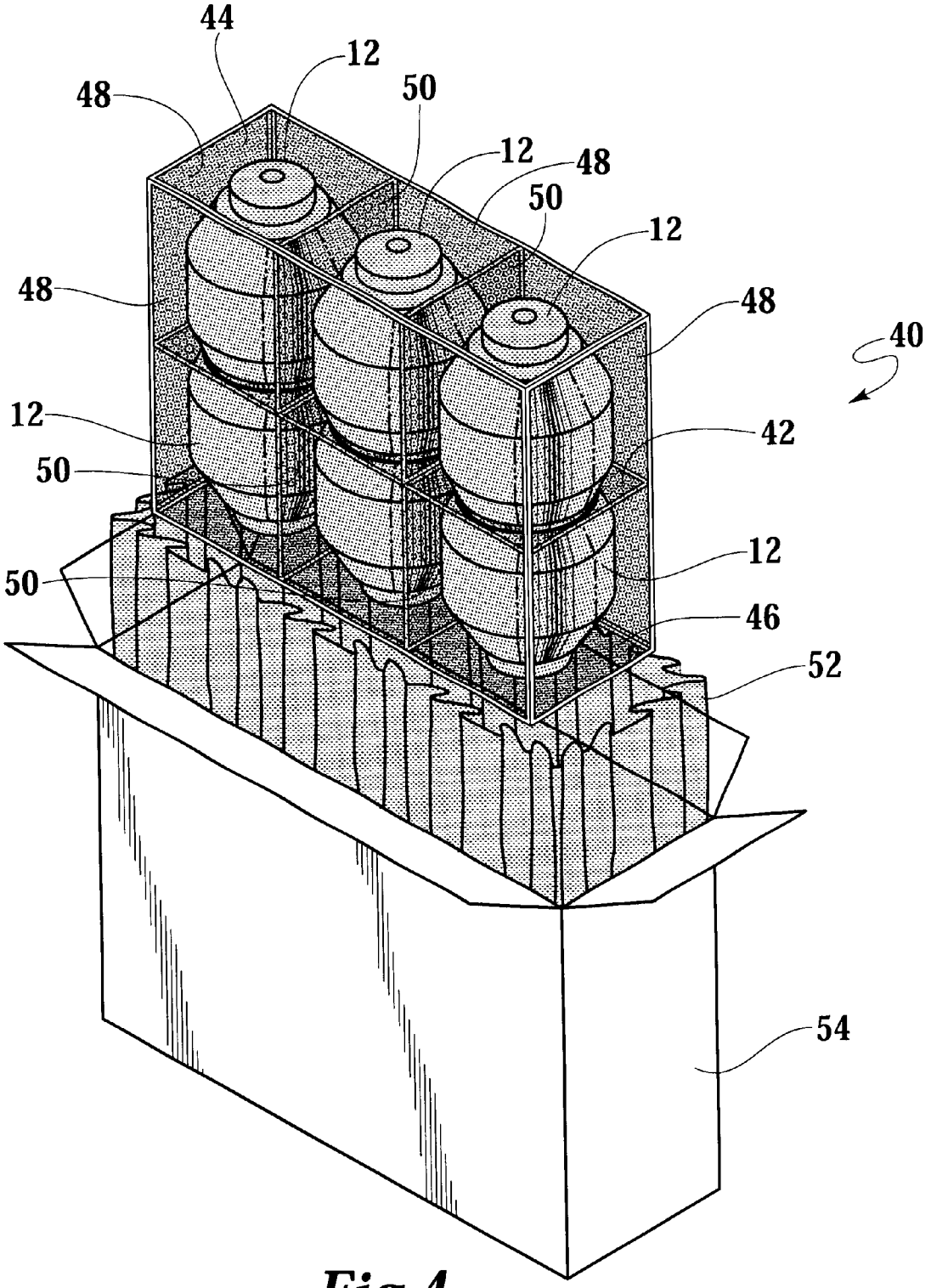
FIG. 4 is a partially exploded, isometric view a system for packaging explosive products for transportation according to the present invention.

In the illustrated embodiment, the combination of shaped charges 12, jet spoilers 20 and shielding panels 42, 44, 46, 48 and 50 is disposed within an expandable bag 52. Expandable bag 52 may be rather loosely fitting when shaped charges 12 are placed therein, but is subsequently folded in a manner that allows it to be placed in transportation container 54, as best seen in FIG. 4.

Figure 5:
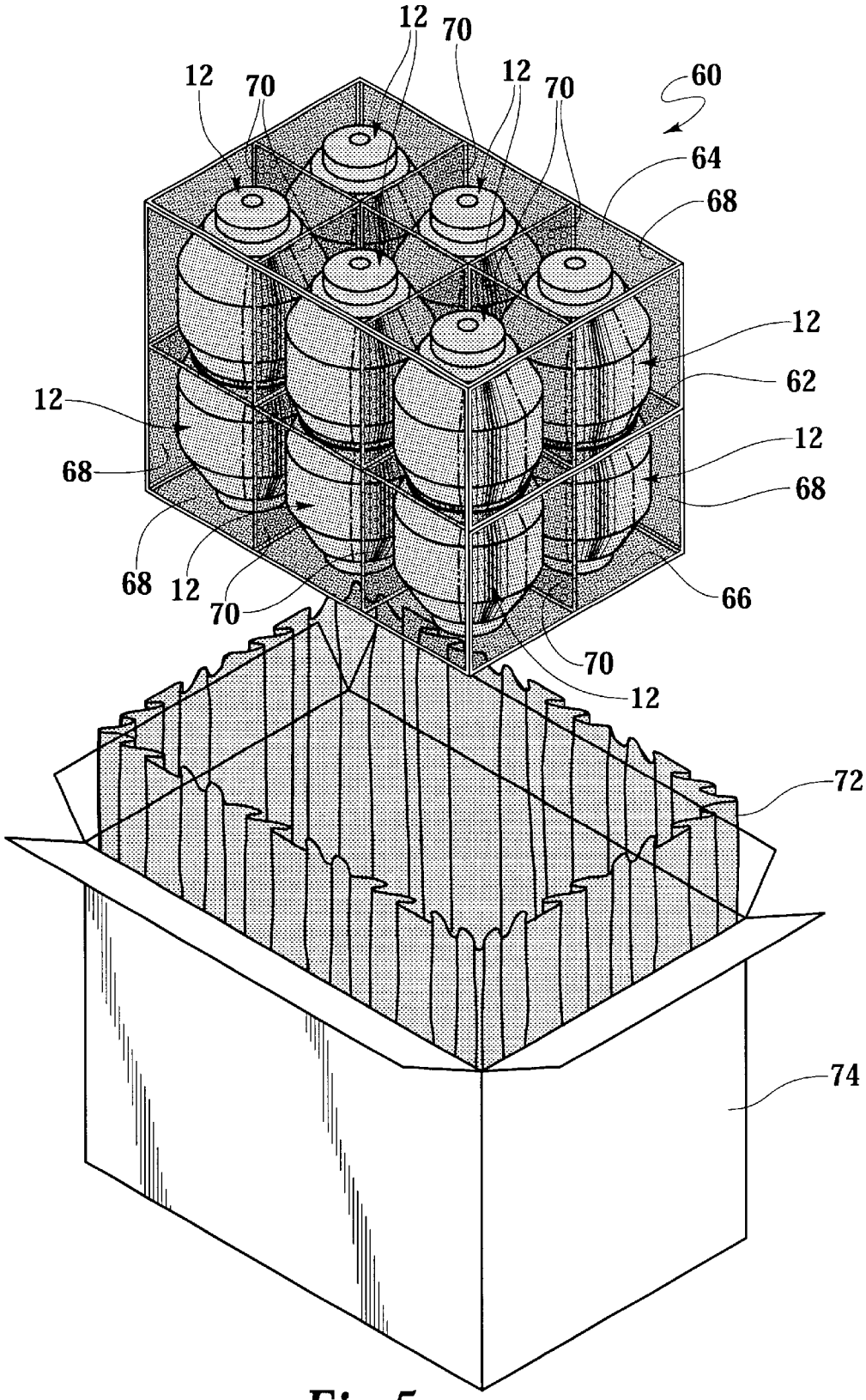
FIG. 5 is a partially exploded, isometric view a system for packaging explosive products for transportation according to the present invention.

Referring next to FIG. 5, a system for packaging explosive products for transportation according to the present invention is depicted and generally designated 60. In the illustrated embodiment, the explosive products are again depicted as shaped charges 12. As above, each shaped charge 12 has a generally cylindrically shaped housing, a liner and a quantity of high explosive powder that is disposed between the housing and the liner. To prevent a jet from occurring if one of the shaped charges 12 is initiated, a jet spoiler is positioned within the cavity formed within each of the shaped charges 12 and defined by the liners.

In the illustrated embodiment, shaped charges 12 are oriented in a layer arrangement. Each layer includes a two by three array of shaped charges 12. Shaped charges 12 are oriented within the layers such that the associated jet spoilers positioned within shaped charges 12 in adjacent layers oppose one another.

A plurality of shielding panels is positioned between and around shaped charges 12. An interlayer shielding panel 62 is disposed between opposing jet spoilers of shaped charges 12 in the two layers. Likewise a top shielding panel 64 is disposed above the upper array of shaped charges 12 while a bottom shielding panel 66 is disposed below the lower array of shaped charges 12. A set of perimeter shielding panels 68 is positioned around shaped charge 12. Additionally, a set of intralayer shielding panels 70 is disposed between adjacent shaped charges 12 within each layer.

In the illustrated embodiment, the combination of shaped charges 12 including jet spoilers and shielding panels 62, 64, 66, 68 and 70 is disposed within an expandable bag 72. Expandable bag 72 may be rather loosely fitting when shaped charges 12 are placed therein, but is subsequently folded in a manner that allows it to be placed in transportation container 74.

Figure 6:
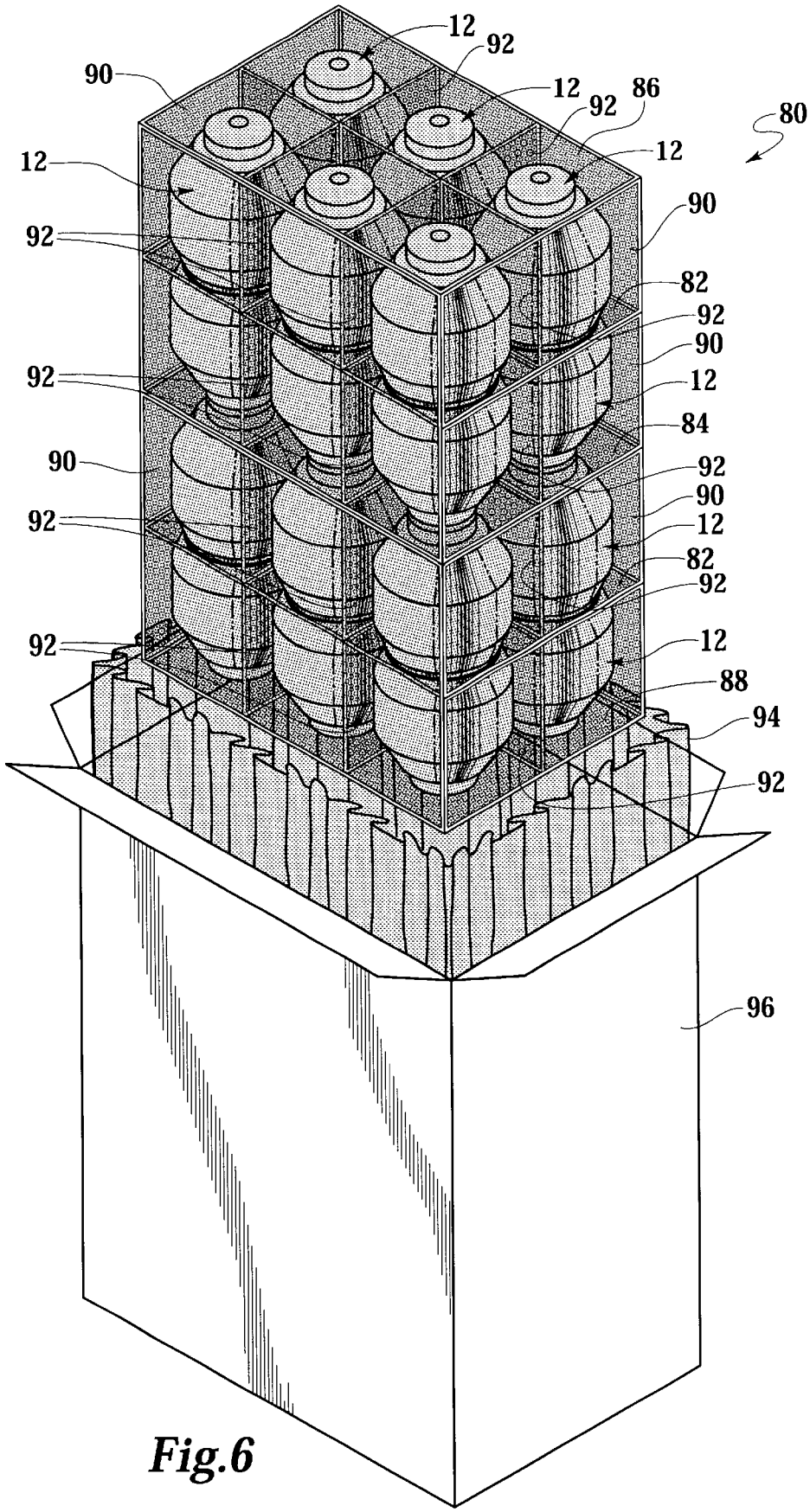
FIG. 6 is a partially exploded, isometric view a system for packaging explosive products for transportation according to the present invention.

In FIG. 6, a system for packaging explosive products for transportation according to the present invention is depicted and generally designated 80. In the illustrated embodiment, the explosive products are again depicted as shaped charges 12. As above, each shaped charge 12 has a generally cylindrically shaped housing, a liner and a quantity of high explosive powder that is disposed between the housing and the liner. To prevent a jet from occurring if one of the shaped charges 12 is initiated, a jet spoiler is positioned within the cavity formed within shaped charges 12 and defined by the liners.

In the illustrated embodiment, shaped charges 12 are oriented in a layer arrangement. Each of the four layers includes a two by three array of shaped charges 12. Shaped charges 12 in the top two layers are oriented such that the associated jet spoilers positioned therein oppose one another. Likewise, shaped charges 12 in the bottom two layers are oriented such that the associated jet spoilers positioned therein oppose one another.

A plurality of shielding panels is positioned between and around shaped charges 12. Interlayer shielding panels 82 are disposed between opposing jet spoilers of shaped charges 12 in the top two and bottom two layers. Additionally, an interlayer shielding panels 84 is disposed between the top two and bottom two layers of shaped charges 12. A top shielding panel 86 is disposed above the top layer of shaped charges 12 while a bottom shielding panel 88 is disposed below the bottom layer of shaped charges 12. A set of perimeter shielding panels 90 is positioned around shaped charge 12. Additionally, a set of intralayer shielding panels 92 is disposed between adjacent shaped charges 12 within each layer.

In the illustrated embodiment, the combination of shaped charges 12 including jet spoilers and shielding panels 82, 84, 86, 88, 90, and 92 is disposed within an expandable bag 94. Expandable bag 94 is loosely fitting around shaped charges 12 and is subsequently folded in a manner that allows it to be placed in transportation container 96.

Even though the embodiments depicted herein have had a relatively small number of explosive products in each layer, from one to six, this is for simplicity and clarity of description as those skilled in the art will understand that larger numbers of explosive products may be placed in each layer, including twenty, fifty or more, depending upon the relative sizes of the explosive products and the transportation container. Likewise, while the present embodiments have depicted either two or four layers of explosive products being packaged in a transportation container, other numbers of layers, both larger and smaller, are also possible. In the case of transporting shaped charges, the number of layers should be even so that the jet spoilers may be configured in the opposing manner describe above.

As can be seen from the above embodiments of the present invention, this system provides an improved method for packaging explosive products for transportation. This system and method not only allow explosive products to pass the present confined Test 6(a), but also, an unconfined Test 6(a) such that the U.N. 1.4S classification will remain achievable. Specifically, the use of the expandable bag of the present invention will allow many explosive products to retain the U.N. 1.4S classification if and when an unconfined Test 6(a) becomes the standard. Additionally or alternatively, use of the shielding panels of the present invention will allow many explosive products to retain the U.N. 1.4S classification under an unconfined Test 6 (a). Further, in the case of shaped charges, jet spoilers and opposing orientation of the shaped charges may be used in addition to or as an alternative to the expandable bag or the shielding panels to retain the U.N. 1.4S classification under an unconfined Test 6(a).

While this invention has been described with a reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A method of packaging shaped charges for transportation comprising the steps of:

positioning a jet spoiler proximate a liner of each shaped charge;

orienting the shaped charges in first and second layers such that the jet spoilers positioned proximate the shaped charges in the first and second layers oppose one another;

disposing a shielding panel between the first and second layers of the shaped charges;

positioning perimeter shielding panels around the shaped charges;

disposing interior shielding panels between adjacent shaped charges within each of the layers of shaped charges; and enclosing the shaped charges in a transportation container.

2. The method as recited in claim 1 wherein the step of positioning the jet spoiler proximate the liner of each of the shaped charges further comprises disposing the jet spoiler within a housing of the shaped charges and in substantial contact with the liner.

3. The method as recited in claim 1 wherein the the first layer further comprises a first array of shaped charges and wherein the second layer further comprises a second array of shaped charges.

4. The method as recited in claim 1 further comprising the step of orienting the shaped charges in third and fourth layers such that the jet spoilers positioned proximate the shaped charges in the third and fourth layers oppose one another.

5. The method as recited in claim 1 further comprising the step of placing an expandable bag around the shaped charges prior to enclosing the shaped charges in a transportation container.

6. A method of packaging shaped charges for transportation comprising the steps of:

positioning a jet spoiler proximate a liner of each shaped charge;

orienting the shaped charges in first and second layers such that the jet spoilers positioned proximate the shaped charges an the first and second layers oppose one another;

placing an expandable bag around the shaped charges, the expandable bag comprising a ballistic cloth operable to expand in the presence of explosion gases; and enclosing the expandable bag in a transportation container.

7. The method as recited in claim 6 wherein the step of positioning the jet spoiler proximate the liner of each of the shaped charges further comprises disposing the jet spoiler within a housing of the shaped charges and in substantial contact with the liner.

8. The method as recited in claim 6 wherein the first layer further comprises a first array of shaped charges and wherein the second layer further comprises a second array of shaped charges.

9. The method as recited in claim 6 further comprising the step of orienting the shaped charges in third and fourth layers such that the jet spoilers positioned proximate the shaped charges in the third and fourth layers oppose one another.

10. The method as recited in claim 6 further comprising the step of disposing perimeter shielding panels around the shaped charges.

11. The method as recited in claim 6 further comprising the step of disposing interior shielding panels between adjacent shaped charges within each of the layers of shaped charges.

12. The method as recited in claim 6 further comprising the step of disposing perimeter shielding panels around the shaped charges and interior shielding panels between adjacent shaped charges within each of the layers of shaped charges.

13. A system for packaging shaped charges for transportation comprising:

a jet spoiler positioned proximate a liner of each of the shaped charges, the shaped charges being oriented in first and second layers such that the jet spoilers positioned proximate the shaped charges in the first and second layers oppose one another;

a shielding panel disposed between the shaped charges of the first and second layers;

an expandable bag surrounding the shaped charges, the expandable bag comprising a ballistic cloth operable to expand in the presence of explosion gases; and a transportation container enclosing the expandable bag therein.

14. The system as recited in claim 13 wherein the jet spoilers are disposed within a housing of the shaped charges in substantial contact with the liner.

15. The system as recited in claim 13 wherein the first layer further comprises a first array of shaped charges and wherein the second layer further comprises a second array of shaped charges.

16. The system as recited in claim 13 further comprising shaped charges oriented in third and fourth layers such that the jet spoilers positioned proximate the shaped charges in the third and fourth layers oppose one another.

17. The system as recited in claim 13 further comprising perimeter shielding panels disposed around the shaped charges.

18. The system as recited in claim 13 further comprising interior shielding panels disposed between adjacent shaped charges within each of the layers of shaped charges.

19. The system as recited in claim 13 further comprising perimeter shielding panels disposed around the shaped charges and interior shielding panels disposed between adjacent shaped charges within each of the layers of shaped charges.

20. A system for packaging shaped charges for transportation comprising:

a jet spoiler positioned proximate a liner of each of the shaped charges, the shaped charges being oriented in first and second layers such that the jet spoilers positioned proximate the shaped charges in the first and second layers oppose one another;

an expandable bag surrounding the shaped charges, the expandable bag comprising a ballistic cloth operable to expand in the presence of explosion gases; and a transportation container enclosing the expandable bag therein.

21. The system as recited in claim 20 wherein the first layer further comprises a first array of shaped charges and wherein the second layer further comprises a second array of shaped charges.

22. The system as recited in claim 20 further comprising perimeter shielding panels disposed around the shaped charges.

23. The system as recited in claim 20 further comprising interior shielding panels disposed between adjacent shaped charges within each of the layers of shaped charges.

24. The system as recited in claim 20 further comprising perimeter shielding panels disposed around the shaped charges and interior shielding panels between adjacent shaped charges within each of the layers of shaped charges.

* * * * *

UNITED STATES PATENT AND TRADEMARK OFFICE

CERTIFICATE OF CORRECTION

PATENT NO. : 6,629,597 B2
DATED : October 7, 2003
INVENTOR(S) : James Marshall Barker It is certified that error appears in the above-identified patent and that said Letters Patent is hereby corrected as shown below:

Column 8,
Line 47, "the the" should read -- the --.

Signed and Sealed this

Twenty-fourth Day of February, 2004

JON W. DUDAS
*Acting Director of the United States Patent and Trademark Office*